US007510095B2

(12) United States Patent
Comeau et al.

(10) Patent No.: US 7,510,095 B2
(45) Date of Patent: Mar. 31, 2009

(54) SYSTEM COMPRISING A RADIALLY ALIGNED CONTAINER AND CLOSURE

(75) Inventors: Raymond Comeau, Agawam, MA (US); Drew McNary, East Longmeadow, MA (US)

(73) Assignee: Berry Plastics Corporation, Evansville, IN (US)

( * ) Notice: Subject to any disclaimer, the term of this patent is extended or adjusted under 35 U.S.C. 154(b) by 677 days.

(21) Appl. No.: 11/077,585

(22) Filed: Mar. 11, 2005

(65) Prior Publication Data

US 2006/0201904 A1 Sep. 14, 2006

(51) Int. Cl.

| | |
|---|---|
| ***B65D 41/00*** | (2006.01) |
| ***B65D 51/18*** | (2006.01) |
| *B65D 47/04* | (2006.01) |
| *B65D 51/04* | (2006.01) |

(52) U.S. Cl. ..... 215/321; 215/317; 215/235; 215/237; 220/254.3; 220/837; 222/556

(58) Field of Classification Search ..... 215/235, 215/237, 317, 321, 330, 331, 44; 220/254.1, 220/254.3, 254.5, 254.7; 222/554
See application file for complete search history.

(56) References Cited

U.S. PATENT DOCUMENTS

| | | | |
|---|---|---|---|
| 2,142,636 | A | 1/1939 | Evensen |
| 2,145,560 | A | 1/1939 | Staley |
| 2,322,527 | A | 6/1943 | Leatherman |
| 3,604,585 | A | 9/1971 | Towns |
| 3,625,386 | A | 12/1971 | Schaefer |
| 3,628,215 | A | 12/1971 | Everburg |
| 3,810,556 | A | 5/1974 | Coursaut |
| 3,872,996 | A | 3/1975 | Dogliotti |
| 3,986,627 | A | 10/1976 | Zapp |
| 4,010,875 | A | 3/1977 | Babiol |
| 4,022,352 | A | 5/1977 | Pehr |
| 4,129,226 | A | 12/1978 | Percival |
| 4,209,100 | A | 6/1980 | Uhlig |
| 4,220,248 | A | 9/1980 | Wilson et al. |

(Continued)

FOREIGN PATENT DOCUMENTS

| | | |
|---|---|---|
| AT | 294675 | 11/1971 |

(Continued)

OTHER PUBLICATIONS

International Search Report, PCT/US06/07719, Sep. 25, 2007, 3 pages (Forms PCT/ISA/210 & 220).

(Continued)

*Primary Examiner*—Anthony D Stashick
*Assistant Examiner*—Ned A Walker
(74) *Attorney, Agent, or Firm*—Barnes & Thornburg LLP

(57) ABSTRACT

A system includes a container including a sidewall and a closure plane attached to the side wall and including an opening, a neck region on the sidewall being adjacent to the closure plane. The system also includes a closure including a cap closure with a fitment adapted to fit in the opening, a circumferentially depending outer skirt adapted to secure the closure to the neck region of the container, and a hinge attached to the cap closure and the circumferentially depending outer skirt. A method for sealing a closure on a container includes pivoting the closure about a hinge towards a closure plane and engaging a fitment with an opening to provide a friction fit. A method for opening a container having a closure includes disengaging a fitment from an opening and pivoting the closure about a hinge away from a closure plane.

19 Claims, 15 Drawing Sheets

U.S. PATENT DOCUMENTS

| | | | | |
|---|---|---|---|---|
| 4,291,818 | A | | 9/1981 | Nozawa et al. |
| 4,310,105 | A | | 1/1982 | Gach |
| 4,334,639 | A | | 6/1982 | Gach |
| 4,346,810 | A | | 8/1982 | Kneissl |
| 4,358,032 | A | | 11/1982 | Libit |
| 4,369,888 | A | | 1/1983 | Walter |
| 4,371,095 | A | | 2/1983 | Montgomery et al. |
| 4,377,247 | A | | 3/1983 | Hazard et al. |
| 4,378,073 | A | | 3/1983 | Luker |
| 4,386,714 | A | | 6/1983 | Roberto et al. |
| 4,403,712 | A | | 9/1983 | Wiesinger |
| 4,420,089 | A | | 12/1983 | Waler et al. |
| 4,457,458 | A | | 7/1984 | Heinol |
| 4,462,504 | A | | 7/1984 | Roth et al. |
| 4,467,931 | A | | 8/1984 | Gach |
| 4,487,324 | A | | 12/1984 | Ostrowsky |
| 4,503,991 | A | | 3/1985 | Joyce |
| 4,519,517 | A | | 5/1985 | Walter |
| 4,533,058 | A | | 8/1985 | Uhlig |
| 4,545,495 | A | | 10/1985 | Kinsley |
| 4,555,038 | A | | 11/1985 | Nagel, Jr. |
| 4,573,600 | A | | 3/1986 | Dubach |
| 4,580,687 | A | | 4/1986 | Lewis |
| 4,607,768 | A | | 8/1986 | Taber et al. |
| 4,610,371 | A | | 9/1986 | Karkiewicz |
| 4,625,898 | A | | 12/1986 | Hazard |
| 4,629,081 | A | | 12/1986 | McLaren |
| 4,638,916 | A | | 1/1987 | Beck et al. |
| 4,669,622 | A | | 6/1987 | Bennett |
| 4,693,399 | A | | 9/1987 | Hickman et al. |
| 4,696,408 | A | | 9/1987 | Dubach |
| 4,699,283 | A | | 10/1987 | Dubach |
| 4,699,301 | A | | 10/1987 | Blake |
| 4,700,858 | A | | 10/1987 | Bennett |
| 4,711,360 | A | | 12/1987 | Ullman |
| 4,711,363 | A | | 12/1987 | Marino |
| 4,714,181 | A | | 12/1987 | Kozlowski et al. |
| 4,718,567 | A | | 1/1988 | La Vange |
| 4,722,449 | A | | 2/1988 | Dubach |
| 4,723,669 | A | | 2/1988 | Barriac |
| 4,723,671 | A | | 2/1988 | Mears |
| 4,727,999 | A | | 3/1988 | Gach |
| 4,733,801 | A | | 3/1988 | Scammell |
| 4,735,334 | A | | 4/1988 | Abbott |
| 4,742,928 | A | | 5/1988 | Braun |
| 4,747,498 | A | | 5/1988 | Gach |
| 4,778,071 | A | | 10/1988 | Fillmore |
| 4,782,964 | A | | 11/1988 | Poore et al. |
| 4,787,525 | A | | 11/1988 | Joyce |
| 4,790,442 | A | | 12/1988 | Gach |
| 4,793,501 | A | | 12/1988 | Beck |
| 4,793,502 | A | | 12/1988 | Beck |
| 4,795,043 | A | | 1/1989 | Odet et al. |
| 4,795,044 | A | | 1/1989 | Beck |
| 4,801,054 | A | | 1/1989 | Nycz |
| 4,805,790 | A | | 2/1989 | Leonetti et al. |
| 4,807,768 | A | | 2/1989 | Gach |
| 4,807,769 | A | * | 2/1989 | Gach ..... 215/235 |
| 4,809,874 | A | | 3/1989 | Pehr |
| 4,813,560 | A | | 3/1989 | Begley |
| 4,821,898 | A | | 4/1989 | Smalley |
| 4,826,026 | A | | 5/1989 | Gach et al. |
| 4,832,219 | A | | 5/1989 | Nycz |
| 4,832,221 | A | | 5/1989 | Manem |
| 4,838,441 | A | | 6/1989 | Chernack |
| 4,848,612 | A | | 7/1989 | Beck |
| 4,854,473 | A | | 8/1989 | Dubach |
| 4,860,907 | A | | 8/1989 | Sondal |
| 4,881,668 | A | | 11/1989 | Kitterman et al. |
| 4,892,208 | A | | 1/1990 | Sledge |
| 4,898,292 | A | | 2/1990 | VerWeyst et al. |
| 4,911,324 | A | * | 3/1990 | Dubach ..... 220/838 |
| 4,915,268 | A | | 4/1990 | Lay et al. |
| 4,917,253 | A | | 4/1990 | Dutt |
| 4,919,286 | A | | 4/1990 | Agbay, Sr. |
| 4,921,113 | A | | 5/1990 | Dubach |
| 4,936,494 | A | | 6/1990 | Weidman |
| 4,940,167 | A | | 7/1990 | Fillmore et al. |
| 4,948,003 | A | | 8/1990 | Munoz |
| 4,955,513 | A | | 9/1990 | Bennett |
| 5,007,555 | A | | 4/1991 | Beck |
| 5,031,784 | A | | 7/1991 | Wright |
| 5,040,691 | A | | 8/1991 | Hayes et al. |
| 5,048,730 | A | | 9/1991 | Forsyth et al. |
| 5,067,624 | A | | 11/1991 | Thanisch |
| 5,069,367 | A | | 12/1991 | Salmon et al. |
| 5,083,671 | A | | 1/1992 | Hayes |
| 5,088,612 | A | | 2/1992 | Storar et al. |
| 5,096,077 | A | | 3/1992 | Odet et al. |
| 5,115,931 | A | | 5/1992 | Dubach |
| 5,123,561 | A | | 6/1992 | Gross |
| 5,139,181 | A | | 8/1992 | VerWeyst |
| 5,141,138 | A | | 8/1992 | Odet et al. |
| 5,143,234 | A | | 9/1992 | Lohrman et al. |
| 5,147,054 | A | | 9/1992 | Pehr |
| 5,148,912 | A | | 9/1992 | Nozawa |
| 5,169,035 | A | | 12/1992 | Imbery, Jr. |
| 5,201,440 | A | | 4/1993 | Gross |
| 5,207,783 | A | | 5/1993 | Burton |
| 5,211,301 | A | | 5/1993 | Groya et al. |
| 5,219,100 | A | | 6/1993 | Beck et al. |
| 5,221,017 | A | | 6/1993 | Cistone et al. |
| 5,251,793 | A | | 10/1993 | Bolen, Jr. et al. |
| 5,254,314 | A | | 10/1993 | Yu et al. |
| 5,257,708 | A | | 11/1993 | Dubach |
| 5,271,531 | A | * | 12/1993 | Rohr et al. ..... 222/212 |
| 5,273,177 | A | | 12/1993 | Campbell |
| 5,287,983 | A | | 2/1994 | Reil et al. |
| 5,322,176 | A | | 6/1994 | Dubach |
| 5,332,131 | A | | 7/1994 | Pehr |
| 5,335,802 | A | * | 8/1994 | Brach et al. ..... 215/235 |
| 5,356,018 | A | | 10/1994 | Dubach |
| 5,358,130 | A | | 10/1994 | Mengeu et al. |
| 5,358,151 | A | | 10/1994 | Strasenburgh |
| 5,361,920 | A | | 11/1994 | Nozawa et al. |
| 5,368,176 | A | | 11/1994 | Thanisch |
| 5,386,918 | A | | 2/1995 | Neveras et al. |
| 5,392,938 | A | | 2/1995 | Dubach |
| 5,395,015 | A | | 3/1995 | Bolen, Jr. et al. |
| 5,395,590 | A | | 3/1995 | Swaniger et al. |
| 5,400,912 | A | | 3/1995 | Brown et al. |
| 5,402,900 | A | | 4/1995 | Glynn |
| 5,405,031 | A | | 4/1995 | Derksen |
| 5,417,350 | A | | 5/1995 | Koo |
| 5,423,442 | A | | 6/1995 | Nozawa et al. |
| 5,427,260 | A | | 6/1995 | Mueller et al. |
| 5,435,456 | A | | 7/1995 | Dubach |
| 5,437,383 | A | | 8/1995 | Stull |
| 5,447,247 | A | | 9/1995 | Derksen |
| 5,456,294 | A | | 10/1995 | Tsao et al. |
| 5,462,183 | A | | 10/1995 | Rohr et al. |
| 5,464,112 | A | | 11/1995 | Guillot |
| 5,482,172 | A | | 1/1996 | Braddock |
| 5,484,070 | A | | 1/1996 | Graham |
| 5,489,035 | A | | 2/1996 | Fuchs |
| 5,494,185 | A | | 2/1996 | Dubach |
| 5,499,736 | A | | 3/1996 | Kohl |
| 5,523,236 | A | | 6/1996 | Nuzzo |
| 5,531,349 | A | | 7/1996 | Wojcik et al. |
| 5,540,343 | A | | 7/1996 | Schumacher |
| 5,547,091 | A | | 8/1996 | Neveras et al. |
| 5,558,239 | A | | 9/1996 | Dubach |
| 5,573,127 | A | | 11/1996 | Takahashi et al. |
| 5,577,626 | A | | 11/1996 | Henkel et al. |

| | | | | |
|---|---|---|---|---|
| 5,579,934 | A | 12/1996 | Buono | |
| 5,579,957 | A | 12/1996 | Gentile et al. | |
| 5,588,546 | A | 12/1996 | Farside | |
| 5,605,240 | A | 2/1997 | Guglielmini | |
| 5,620,107 | A | 4/1997 | Takeuchi | |
| 5,642,824 | A | 7/1997 | Hess, III et al. | |
| 5,683,016 | A | 11/1997 | Santagiuliana | |
| 5,685,444 | A | 11/1997 | Valley | |
| 5,718,347 | A | 2/1998 | Walker et al. | |
| 5,735,418 | A | 4/1998 | Erb et al. | |
| 5,755,352 | A | 5/1998 | Wojcik et al. | |
| 5,762,216 | A * | 6/1998 | Takeuchi | 215/235 |
| 5,765,705 | A | 6/1998 | Deubel | |
| 5,769,253 | A | 6/1998 | Gross | |
| 5,785,193 | A | 7/1998 | Kobayashi et al. | |
| 5,794,308 | A | 8/1998 | Rentsch et al. | |
| 5,806,698 | A * | 9/1998 | Aguirrezabal | 215/235 |
| 5,810,188 | A | 9/1998 | Novakoski et al. | |
| 5,810,207 | A | 9/1998 | Hayashida | |
| 5,842,806 | A | 12/1998 | Rettke | |
| 5,853,093 | A | 12/1998 | Neiger | |
| 5,855,288 | A | 1/1999 | Dallas, Jr. | |
| 5,860,543 | A | 1/1999 | Decelles | |
| 5,865,353 | A | 2/1999 | Baudin | |
| 5,865,354 | A | 2/1999 | Bansal | |
| 5,868,265 | A | 2/1999 | Kobayashi | |
| 5,875,942 | A | 3/1999 | Ohmi et al. | |
| 5,913,435 | A | 6/1999 | Fuchs | |
| 5,927,566 | A | 7/1999 | Mueller | |
| 5,934,496 | A | 8/1999 | Mogard et al. | |
| 5,950,848 | A | 9/1999 | Baudin | |
| 5,967,384 | A | 10/1999 | Mengeu et al. | |
| 5,992,659 | A | 11/1999 | Nofer et al. | |
| 5,996,859 | A | 12/1999 | Beck | |
| 6,039,197 | A | 3/2000 | Braun | |
| 6,041,477 | A | 3/2000 | Rentsch et al. | |
| 6,041,953 | A | 3/2000 | Goodall | |
| 6,050,434 | A | 4/2000 | McNab | |
| 6,056,142 | A * | 5/2000 | Elliott | 220/278 |
| 6,082,568 | A | 7/2000 | Flanagan | |
| 6,095,354 | A | 8/2000 | Herr et al. | |
| 6,116,441 | A | 9/2000 | Decelles et al. | |
| 6,116,477 | A * | 9/2000 | Kreiseder et al. | 222/556 |
| 6,152,320 | A | 11/2000 | Hierzer et al. | |
| 6,170,710 | B1 | 1/2001 | Suffa | |
| 6,170,719 | B1 | 1/2001 | Wilkinson et al. | |
| 6,216,905 | B1 | 4/2001 | Mogard et al. | |
| 6,234,334 | B1 | 5/2001 | Suarez | |
| 6,253,937 | B1 | 7/2001 | Anderson | |
| 6,257,431 | B1 | 7/2001 | Baudin | |
| 6,264,051 | B1 | 7/2001 | Reidenbach | |
| 6,283,317 | B1 | 9/2001 | Benoit-gonin et al. | |
| 6,299,005 | B1 | 10/2001 | Higgins | |
| 6,305,563 | B1 | 10/2001 | Elliott | |
| 6,315,160 | B1 | 11/2001 | Gaiser et al. | |
| 6,321,923 | B1 * | 11/2001 | Wood | 215/235 |
| 6,382,476 | B1 | 5/2002 | Randall et al. | |
| 6,405,885 | B1 | 6/2002 | Elliott | |
| 6,405,896 | B2 | 6/2002 | Jud et al. | |
| 6,409,034 | B2 | 6/2002 | Schorner | |
| 6,419,101 | B1 * | 7/2002 | Hessel et al. | 215/253 |
| 6,439,410 | B1 | 8/2002 | Dubach | |
| 6,460,712 | B2 | 10/2002 | Smith et al. | |
| 6,460,726 | B1 | 10/2002 | Hierzer et al. | |
| 6,478,184 | B2 * | 11/2002 | Berge et al. | 220/831 |
| 6,481,588 | B1 | 11/2002 | Wagner | |
| 6,502,722 | B1 | 1/2003 | Shimizu et al. | |
| 6,520,370 | B2 | 2/2003 | Nyman et al. | |
| 6,530,493 | B2 | 3/2003 | Anderson | |
| 6,550,646 | B1 | 4/2003 | Takahara et al. | |
| 6,575,330 | B2 | 6/2003 | Rousselet | |
| 6,578,744 | B2 | 6/2003 | Hierzer et al. | |
| 6,622,895 | B2 | 9/2003 | McClean et al. | |
| 6,631,820 | B2 | 10/2003 | Harrold et al. | |
| 6,631,833 | B2 * | 10/2003 | Harriman et al. | 222/536 |
| 6,634,060 | B1 | 10/2003 | Lagler et al. | |
| 6,644,487 | B2 | 11/2003 | Smith et al. | |
| 6,685,041 | B1 | 2/2004 | Geisinger | |
| 6,688,495 | B2 | 2/2004 | Masuda | |
| 6,688,501 | B2 | 2/2004 | DeGroot et al. | |
| 6,702,137 | B1 | 3/2004 | Kowa et al. | |
| 6,932,240 | B2 * | 8/2005 | Harriman et al. | 222/92 |
| 7,128,227 | B2 * | 10/2006 | Skillin et al. | 215/235 |
| 2001/0035389 | A1 | 11/2001 | Anderson | |
| 2001/0040176 | A1 | 11/2001 | Kimble et al. | |
| 2001/0048008 | A1 | 12/2001 | McClean et al. | |
| 2001/0050264 | A1 | 12/2001 | Schorner | |
| 2001/0050291 | A1 | 12/2001 | Jud et al. | |
| 2001/0052531 | A1 | 12/2001 | Randall et al. | |
| 2002/0104843 | A1 | 8/2002 | Smith et al. | |
| 2002/0108922 | A1 | 8/2002 | Hierzer | |
| 2002/0113097 | A1 * | 8/2002 | Harriman et al. | 222/534 |
| 2002/0125203 | A1 | 9/2002 | Bried et al. | |
| 2002/0130134 | A1 | 9/2002 | Rennie | |
| 2002/0134746 | A1 | 9/2002 | Reidenbach | |
| 2002/0148802 | A1 | 10/2002 | Takahashi et al. | |
| 2002/0175137 | A1 | 11/2002 | Rousselet | |
| 2003/0024949 | A1 | 2/2003 | Garcia et al. | |
| 2003/0057209 | A1 | 3/2003 | Seelhofer | |
| 2003/0057237 | A1 | 3/2003 | Stull et al. | |
| 2003/0062369 | A1 | 4/2003 | Hierzer et al. | |
| 2003/0089746 | A1 | 5/2003 | Odet | |
| 2003/0102338 | A1 | 6/2003 | Martin | |
| 2003/0116879 | A1 | 6/2003 | Mueller et al. | |
| 2003/0150191 | A1 | 8/2003 | Odet | |
| 2003/0205549 | A1 | 11/2003 | Harrold et al. | |
| 2004/0011829 | A1 | 1/2004 | Gaiser et al. | |
| 2004/0016714 | A1 * | 1/2004 | Wood et al. | 215/235 |
| 2004/0026465 | A1 | 2/2004 | Klopfer | |
| 2004/0056050 | A1 | 3/2004 | Nazari | |
| 2004/0065697 | A1 | 4/2004 | DeGroot et al. | |

FOREIGN PATENT DOCUMENTS

| | | |
|---|---|---|
| CH | 675 410 | 9/1999 |
| DE | 41 23 732 | 1/1992 |
| DE | 41 28 622 | 6/1992 |
| EP | 0 044 570 | 6/1985 |
| EP | 0 496 644 | 7/1992 |
| EP | 0 569 747 | 11/1993 |
| EP | 0 634 338 | 1/1995 |
| FR | 2 662 144 | 11/1991 |
| GB | 2 076 378 | 12/1981 |
| GB | 2 166 123 | 4/1986 |
| GB | 2 224 309 | 5/1990 |
| JP | 1 254 566 | 10/1989 |
| JP | 1 279 064 | 11/1989 |
| JP | 2 019 259 | 1/1990 |
| JP | 10338251 | 12/1998 |
| WO | WO 87/00512 | 1/1987 |
| WO | WO 88/01972 | 3/1988 |
| WO | WO 0044638 | 8/2000 |
| WO | WO 02/40365 | 5/2002 |

OTHER PUBLICATIONS

Written Opinion of the International Search Authority, Sep. 25, 2007, 5 pages (Form PCT/ISA/237).

Extended Search Report dated Dec. 28, 2007 for European Application No. 07008824.

European Search Report dated Sep. 20, 2006, European Application No. EP06004619, six pages.

* cited by examiner

SYSTEM COMPRISING A RADIALLY ALIGNED CONTAINER AND CLOSURE

FIELD OF THE INVENTION

The present invention relates generally to a system including a hinged closure and a tube container and a method for sealing a hinged closure on a tube container.

BACKGROUND INFORMATION

Tube containers are conventional and have been used for consumer paste products including toothpaste. Tube containers have used various types of closures, including screw top closures and snap top closures. However, closures for tubed products have each had some disadvantage. Screw top closures, being separable from the tube, have the disadvantage that they may become lost and therefore may fail to protect the contents of the tube from the elements or to protect the user from the contents of the tube. Additionally, screw threads may become fouled by the contents of the tube. Snap top closures may have the disadvantage that certain types of materials may contaminate the closure mechanism since the snap top may not properly seal the opening of the tube.

The following patents are believed to discuss closures and containers. U.S. Pat. No. 6,152,320 is believed to describe a flip-top type closure that resealably seals a fluid container. The closure includes a body portion, which is attachable to the fluid container, and a cap portion. The cap portion is connected to the body portion by two hinges and is rotatable about the two hinges so that a spout of the body portion may be inserted into the mouth without interference by the cap portion. The closure may include a tamper-evident band to visually indicate tampering with the contents of the fluid container. The closure may also include a pull-tab seal secured to the spout to prevent spillage and/or leakage of the contents of the fluid container.

U.S. Pat. No. 6,321,923 is believed to describe a closure for a container opening. The closure includes a base for mounting to the container and a lid movable between a closed position and an open position. The lid and base are connected by a bistable, snap-action hinge structure having a web with a reduced thickness region along a lateral edge.

U.S. Pat. No. 6,439,410 is believed to describe plastic snap-on hinged closures each having a bottom part and a cap that are attached to each other by a snap-on hinge with a geometry of the closures having a curvature with varying height and wall thickness extending along the joint. The curvature is elastic when pressure is exerted in the middle and when pulled from the sides.

U.S. Pat. No. 6,460,712 is believed to describe a closure structure for a container that has an opening to the container interior. The closure structure includes a closure base for extending around the container opening. A lid is provided on the closure base and is connected to the base by a hinge web. The hinge web has a first end connected to the closure base, a second end connected to the lid, and two sides which each extend between the first and second ends. A frangible, reduced-thickness section of material initially connects the lid to the closure base and initially connects both of the hinge web sides to the closure base or to the lid for initially holding the lid sealed closed at a tamper-evident, first closed position. The frangible, reduced-thickness section of material subsequently accommodates movement of the lid relative to the first closed position to break the frangible connection and become selectively located at one of the following positions: (1) a second closed position inwardly of the first closed position, and (2) an open position outwardly of both the first closed position and second closed position.

U.S. Pat. No. 6,550,646 is believed to describe a container including a tube member having a trunk portion which is elastically squeezable, and a wide-mouthed neck portion extending upwardly from the trunk portion. A top wall closes a top surface of the neck portion, has a discharge port, and also has a peripheral portion connected to a top end of the neck portion, from which the peripheral portion is made undetachably. A cover plate is connected by a hinge to the neck portion and has a plug for closing the discharge port. The plug depends from an underside of the cover plate, wherein the top wall has a first breaking line which is formed within the peripheral portion of the top wall, and a knob for tearing the first breaking line. The knob is formed on the top wall within the first breaking line.

U.S. Pat. No. 6,575,330 is believed to describe a cap for a container that includes a body, an outlet orifice for dispensing a product from a container, a lid configured to selectively cover at least a portion of the outlet orifice, a snap hinge coupling the lid to the body, and at least one shut-off flap. The at least one shut-off flap may selectively allow the product to be dispensed from the outlet orifice. The at least one shut-off flap and the body may be a single piece formed of a material substantially the same as a material forming the snap hinge.

SUMMARY

A system in accordance with the present disclosure includes a container formed to include a product-discharge outlet and a closure mounted on the container normally to cover the product-discharge outlet. The closure includes a body coupled to the container, a "flip-top" cap, and a hinge coupled to the body and to the flip-top cap. The hinge is configured to support the flip-top cap for movement between a closed position on the body covering the product-discharge outlet and an opened position away from the body. In illustrative embodiments, the container is formed to include an alignment fitting and the closure includes an alignment guide. The alignment guide is included in the body of the closure and arranged to mate with the alignment fitting when the closure is mounted on the container to orient the closure in a specific radial orientation with respect to the container. In an exemplary embodiment of the present invention, a system includes a container including a sidewall and a closure plane attached to the side wall and including an opening, a neck region on the sidewall is adjacent to the closure plane. The system also includes a closure including a cap closure with a fitment adapted to fit in the opening, a circumferentially depending outer skirt adapted to secure the closure to the neck region of the container, and a hinge attached to the cap closure and the circumferentially depending outer skirt.

According to an exemplary embodiment of the present invention, a method for sealing a closure on a container includes pivoting the closure about a hinge towards a closure plane and engaging a fitment with an opening to provide a friction fit.

According to an exemplary embodiment of the present invention, a method for opening a container having a closure includes disengaging a fitment from an opening and pivoting the closure about a hinge away from a closure plane.

According to an example embodiment of the present invention, a system includes: a container including a sidewall and a closure plane attached to the side wall, the closure plane including an opening, a neck region on the sidewall adjacent to the closure plane; and a closure including a cap closure with a fitment adapted to engage with the opening of the container to seal an interior of the container, a circumferentially depending outer skirt adapted to secure the closure to the neck region of the container, the cap closure hingedly attached to the outer skirt, the fitment and opening of the container engageable through an opening in the closure.

The cap closure and the outer skirt may be attached by a butterfly hinge including at least two tabs, and the butterfly hinge may be adapted to bias the cap closure away from the circumferentially depending outer skirt. Each of the tabs of the butterfly hinge may be a substantially equal thickness along a length of the tab.

The cap closure may include a stabilizing ridge arranged adjacent to the butterfly hinge and adapted to maintain the cap closure and the outer skirt in alignment during at least one of a closing operation and an opening operation.

The fitment of the closure cap may be configured to provide a friction fit with the opening of the closure plane of the container.

The opening of the container may be located substantially centrally on the closure plane of the container.

The container may include a bottom opposite the closure plane.

The container may include a flexible tube.

The container may include a first attachment arrangement in the neck region, and the closure may include a second attachment arrangement adapted to cooperate with the first attachment arrangement to secure the closure to the neck region of the container.

A first one of the first attachment arrangement and the second attachment arrangement may include an annular groove. A second one of the first attachment arrangement and the second attachment arrangement may include an annular ring arranged to be received in the annular groove.

The first and second attachment arrangements may include a cooperating screw thread arrangement.

The cap closure may be adapted to engage cooperatively with an outer surface of the circumferentially depending outer skirt to close the container. A first annular ring on the cap closure may be adapted to cooperate with a second annular ring on the outer surface of the circumferentially depending outer skirt to close the container.

According to an example embodiment of the present invention, a method is provided for sealing a closure on a container, the container including a sidewall and a closure plane attached to the side wall, the closure plane including an opening, a neck region on the sidewall adjacent to the closure plane, the closure including a cap closure with a fitment adapted to engage with the opening of the container to seal an interior of the container, a circumferentially depending outer skirt adapted to secure the closure to the container, the cap closure hingedly connected to the outer skirt, the fitment and the opening of the container engageable through an opening of the closure. The method may include: pivoting the closure about the hinge toward the closure plane; and frictionally engaging the fitment with the opening to seal the interior of the container.

The cap closure may be adapted to engage cooperatively with an outer surface of the circumferentially depending outer skirt to close the container.

According to an example embodiment of the present invention, a method is provided for opening a container having a closure disposed thereon, the container including a sidewall and a closure plane attached to the side wall, the closure plane including an opening, a neck region on the sidewall adjacent to the closure plane, the closure including a cap closure with a fitment adapted to engage with the opening of the container to seal an interior of the container, a circumferentially depending outer skirt adapted to secure the closure to the container, the cap closure hingedly connected to the outer skirt, the fitment and the opening of the container engageable through an opening of the closure. The method may include: disengaging the fitment from the opening; and pivoting the closure about the hinge away from the closure plane.

According to an example embodiment of the present invention, a system includes: an attachment element attachable to a container, the attachment element including a sidewall and a closure plane attached to the side wall, the closure plane including an opening, a neck region on the sidewall adjacent to the closure plane; and a closure including a cap closure with a fitment adapted to engage with the opening of the attachment element, a circumferentially depending outer skirt adapted to secure the closure to the neck region of the attachment element, the cap closure hingedly attached to the outer skirt, the fitment and opening of the attachment element engageable through an opening in the closure.

DETAILED DESCRIPTION

In a container (e.g., a tube) and a closure for the container, the container includes a fitment for receiving a projection arranged on the inside surface of a hinged lid of the closure. The fitment of the container is exposed through an opening in the base portion of the closure. The lid is hinged to the base portion of the closure.

Figure 1:
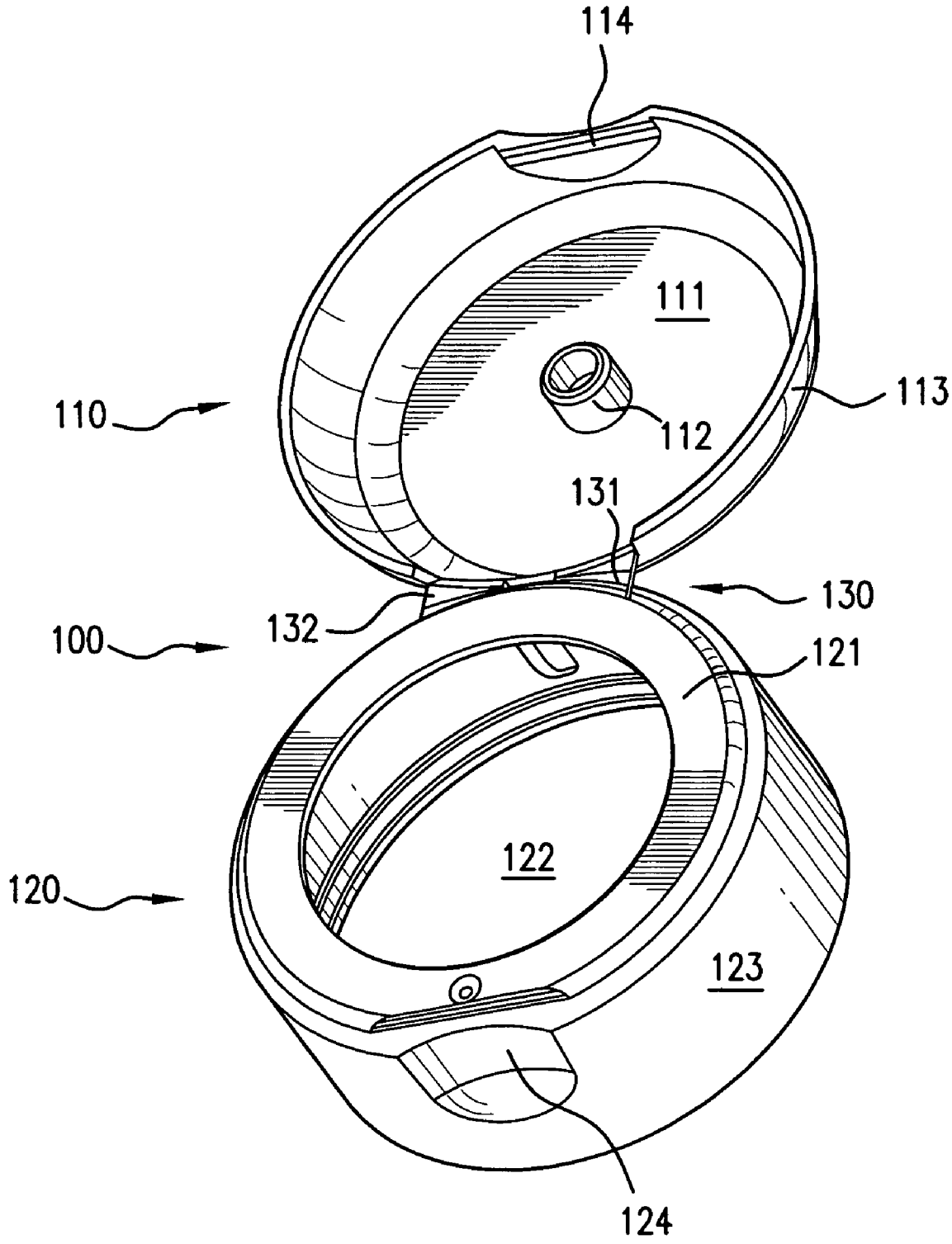
FIG. 1 is a perspective view from above of a closure in an open position according to an exemplary embodiment of the present invention.

FIG. 1 illustrates an exemplary embodiment of a closure 100. Closure 100 includes closure cap 110 and circumferentially depending outer skirt 120 connected by hinge 130. Closure cap 110 includes closure plane 111, projection 112 arranged centrally on closure plane 111, and outer closure skirt 113. Outer closure skirt 113 includes opening tab 114 on a side of closure cap 110 opposite to hinge 130. Hinge 130 includes tabs 131, 132, but may alternatively include more or fewer tabs. Tabs 131, 132 together form a butterfly-type hinge, which may bias the closure cap into an open position. Circumferentially depending outer skirt 120 includes closure plane lip 121, opening 122, skirt 123, and opening depression 124 in skirt 123 opposite to hinge 130.

Figure 2:
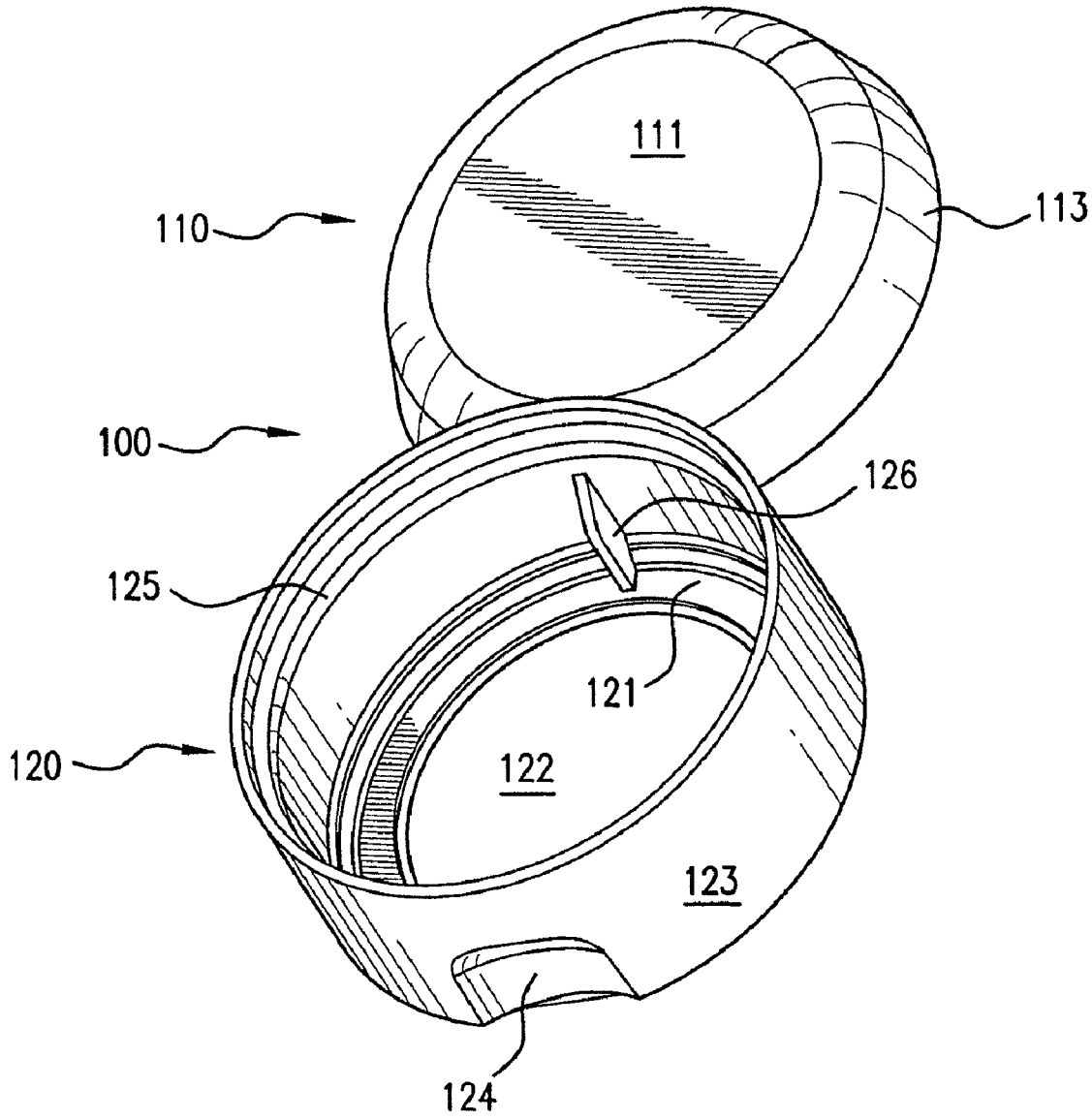
FIG. 2 is a perspective view from below of the closure of FIG. 1 in an open position.

FIG. 2 illustrates the exemplary embodiment of closure 100 of FIG. 1 shown from below. Closure 100 includes closure cap 110 and circumferentially depending outer skirt 120. Closure cap 110 includes closure plane 111 and outer closure skirt 113. Circumferentially depending outer skirt 120 includes closure plane lip 121, opening 122, skirt 123, and opening depression 124 in skirt 123 opposite to the hinge. The bottom view of closure 100 shows circumferentially depending outer skirt 120 also including fitment retaining ring 125 and alignment guide 126. Fitment retaining ring 125 may include a ring or multiple partial ring-shaped sections extending inwardly from skirt 123 and may cooperate with a circumferential groove on a neck region of a container to attach closure 100 to the container. Alternatively, a circumferential groove may be provided in the interior of the skirt 123 adapted to receive an outwardly extending ring or multiple partial ring-shaped sections of the neck region of the container. Alignment guide 126 may extend inwardly from skirt 123 on a specific radial position (as shown, the hinge position, though alternatively other positions may be used) and may cooperate with an axial groove on a container to ensure that closure 100 maintains a specific radial orientation with respect to the container. Alternatively and/or additionally, alignment guide may ensure that closure 100 does not rotate with respect to the container. More than one alignment guide may be provided on the container, and corresponding grooves may be provided on the container, and vice versa.

Figure 3:
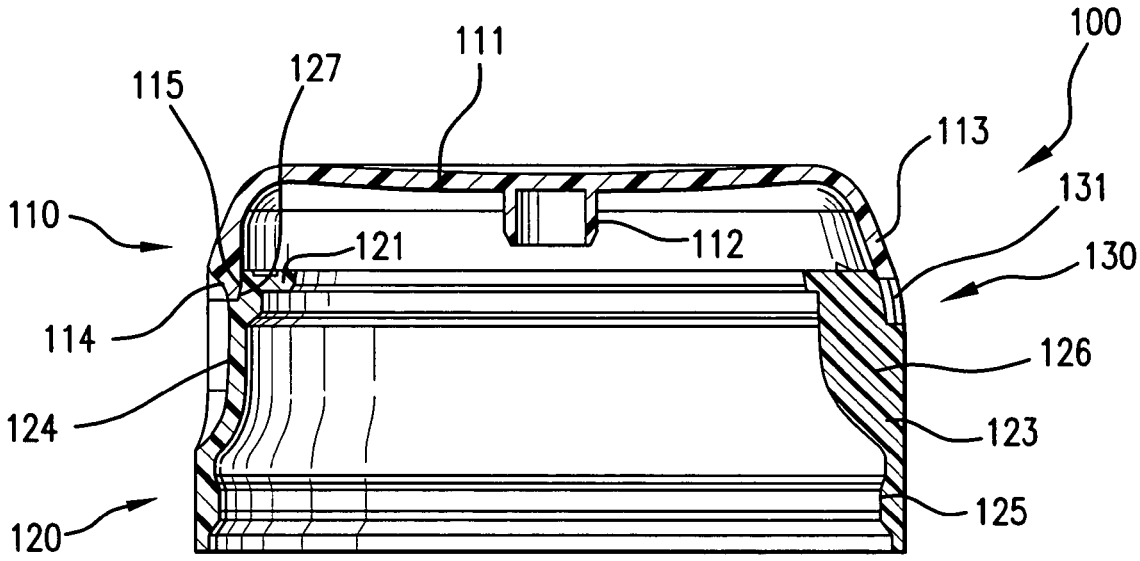
FIG. 3 is a cross-sectional view of the closure of FIG. 1 in a closed position.

FIG. 3 is a cross-sectional view of the closure of FIG. 1 in a closed position. Closure 100 includes closure cap 110 and circumferentially depending outer skirt 120 connected by hinge 130. Closure cap 110 includes closure plane 111, projection 112 arranged centrally on closure plane 111, and outer closure skirt 113. Outer closure skirt 113 includes opening tab 114 on a side of closure cap 110 opposite to hinge 130. Tab 131 of hinge 130 is shown. Circumferentially depending outer skirt 120 includes closure plane lip 121, opening 122, skirt 123, and opening depression 124 in skirt 123 opposite to hinge 130. Also shown on circumferentially depending outer skirt 120 are fitment retaining ring 125 and alignment guide 126. Projection 115 arranged radially inward of opening tab 114 on outer closure skirt 113 engages with indentation 127 on circumferentially depending outer skirt 120 to hold closure cap 110 in a closed position on circumferentially depending outer skirt 120.

The closure may be arranged on a container by cooperatively engaging a screw thread arrangement or by pressing the two elements together until an annular groove(s) in one element cooperatively engages an annular ring(s) or partial ring-shaped segment(s) on the other element. The closure cap of the closure may be opened and closed by pivoting around a hinge. The hinge may bias the closure cap into the open position. The hinge may also bias the closure into the closed position. For example, the hinge may be arranged as a bistable hinge. The closure may be closed by pivoting the closure cap about the hinge. The closure cap may have a projection on an inner side that engages with an opening on the closure plane of the container. The projection may be sized to create a friction fit with the opening on the container. The projection may create a friction fit with an internal diameter of the opening and/or with an external diameter of the opening. Additionally or alternatively, the closure cap may include a projection or depression to engage a corresponding depression or projection on the circumferentially depending outer skirt of the closure to hold the closure cap in a closed position.

Figure 4:
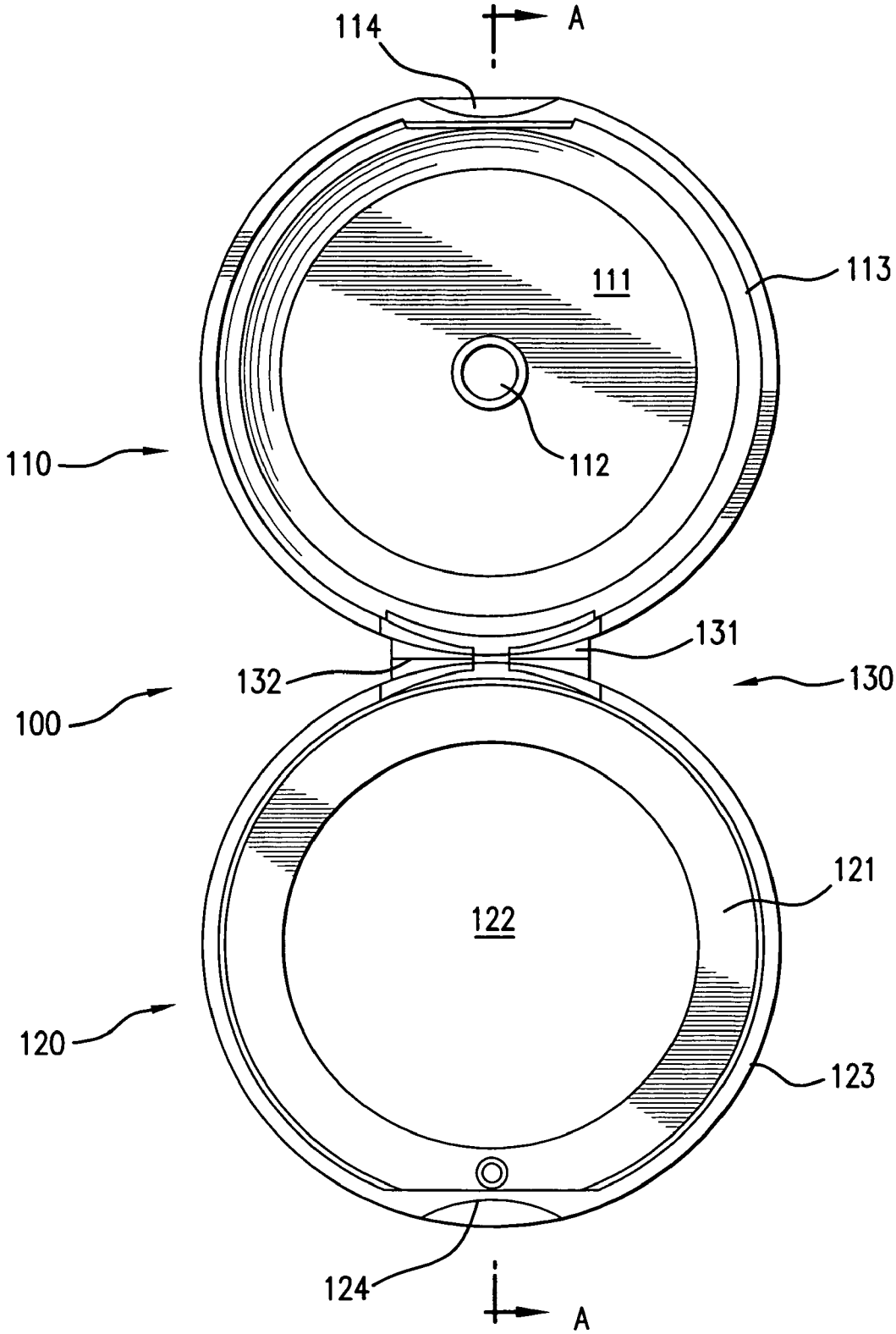
FIG. 4 is a plan view of the closure of FIG. 1 in an open position.

FIG. 4 is a plan view of the closure of FIG. 1 in an open position. FIG. 4 shows closure 100 including closure cap 110 and circumferentially depending outer skirt 120 connected by hinge 130. Closure cap 110 includes closure plane 111, projection 112 arranged centrally on closure plane 111, and outer closure skirt 113. Outer closure skirt 113 includes opening tab 114 on a side of closure cap 110 opposite to hinge 130. Circumferentially depending outer skirt 120 includes closure plane lip 121, opening 122, skirt 123, and opening depression 124 in skirt 123 opposite to hinge 130.

Figure 5:
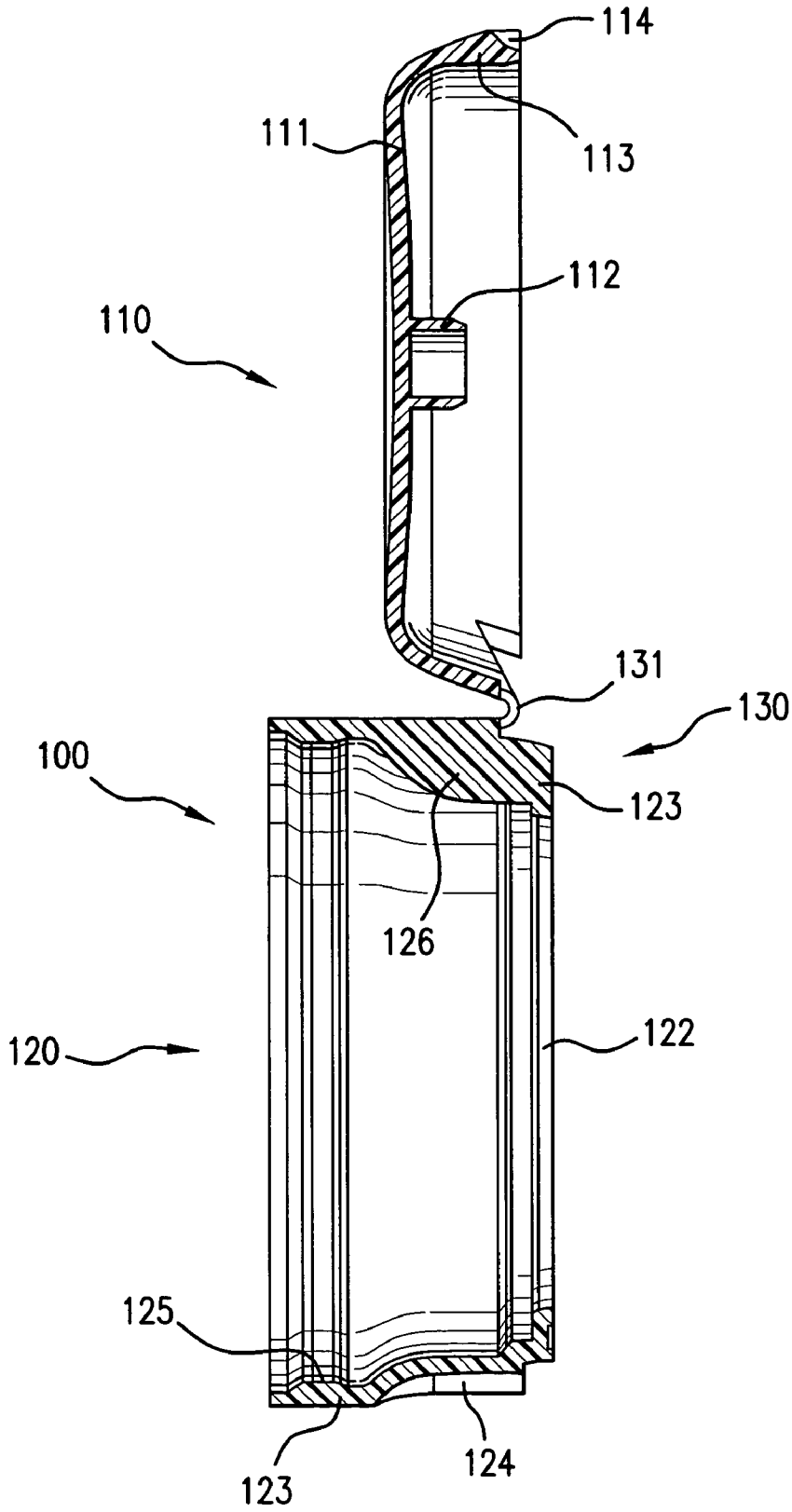
FIG. 5 is a side, cross-sectional view of the closure of FIG. 1 in an open position, taken along line A-A of FIG. 4.

FIG. 5 is a side, cross-sectional view of the closure of FIG. 4 in an open position, taken along line A-A. Closure 100 includes closure cap 110 and circumferentially depending outer skirt 120 connected by hinge 130. Closure cap 110 includes closure plane 111, projection 112 arranged centrally on closure plane 111, and outer closure skirt 113. Outer closure skirt 113 includes opening tab 114 on a side of closure cap 110 opposite to hinge 130. Hinge 130 includes tab 131. Circumferentially depending outer skirt 120 includes closure plane lip 121, opening 122, skirt 123, and opening depression 124 in skirt 123 opposite to hinge 130. Also shown on circumferentially depending outer skirt 120 are fitment retaining ring 125 and alignment guide 126.

Figure 6:
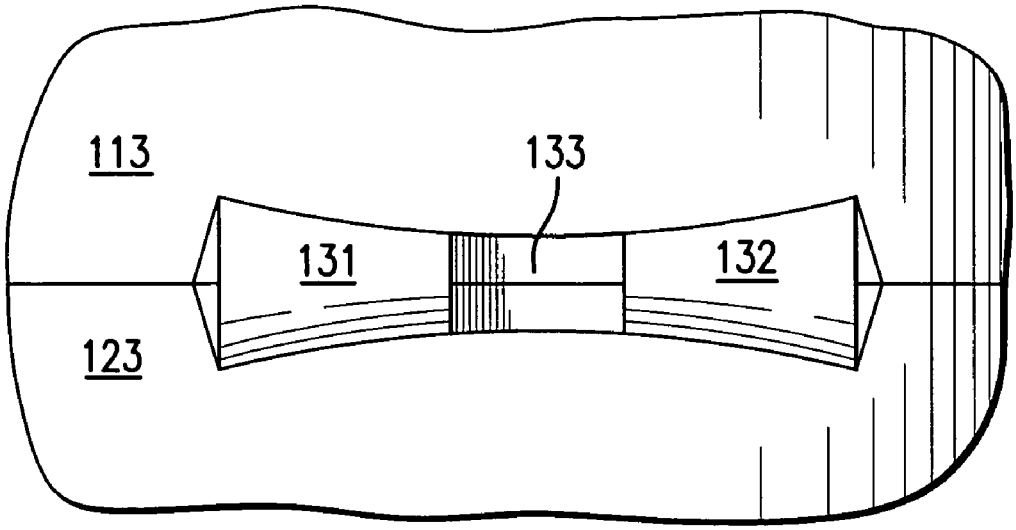
FIG. 6 is a back view of a closure in a closed position according to an exemplary embodiment of the present invention showing the hinge.

FIG. 6 illustrates a back view of a closure in a closed position according to an exemplary embodiment of the present invention. Hinge tabs 131, 132 extend from skirt 123 of circumferentially depending outer skirt to outer closure skirt 113 of closure cap. Hinge tabs 131, 132 may be spaced apart by gap 133 and may be plastic tabs of uniform thickness. Hinge tabs 131, 132 may form a butterfly hinge that may bias the closure into an open position when the closure cap is released from the closed position from the circumferentially depending outer skirt.

Figure 7:
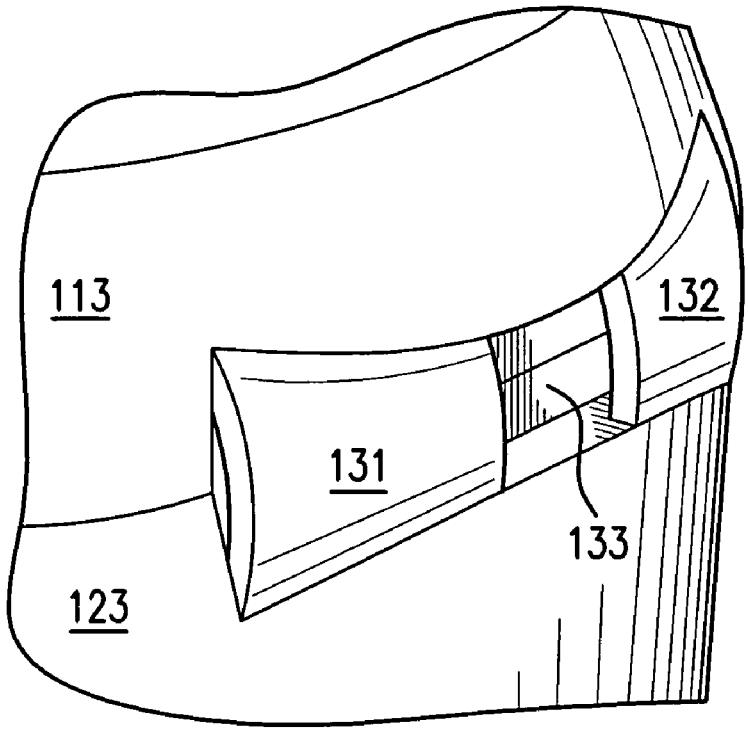
FIG. 7 is another view of the hinge of FIG. 6 with the closure in a closed position.

FIG. 7 is another view of the hinge of FIG. 6 with the closure in a closed position. Hinge tabs 131, 132 extend from skirt 123 of circumferentially depending outer skirt to outer closure skirt 113 of closure cap. Hinge tabs 131, 132 may be spaced apart by gap 133 and may be plastic tabs of uniform thickness. Hinge tabs 131, 132 may form a butterfly hinge that may bias the closure into an open position when the closure cap is released from the closed position from the circumferentially depending outer skirt.

Figure 8:
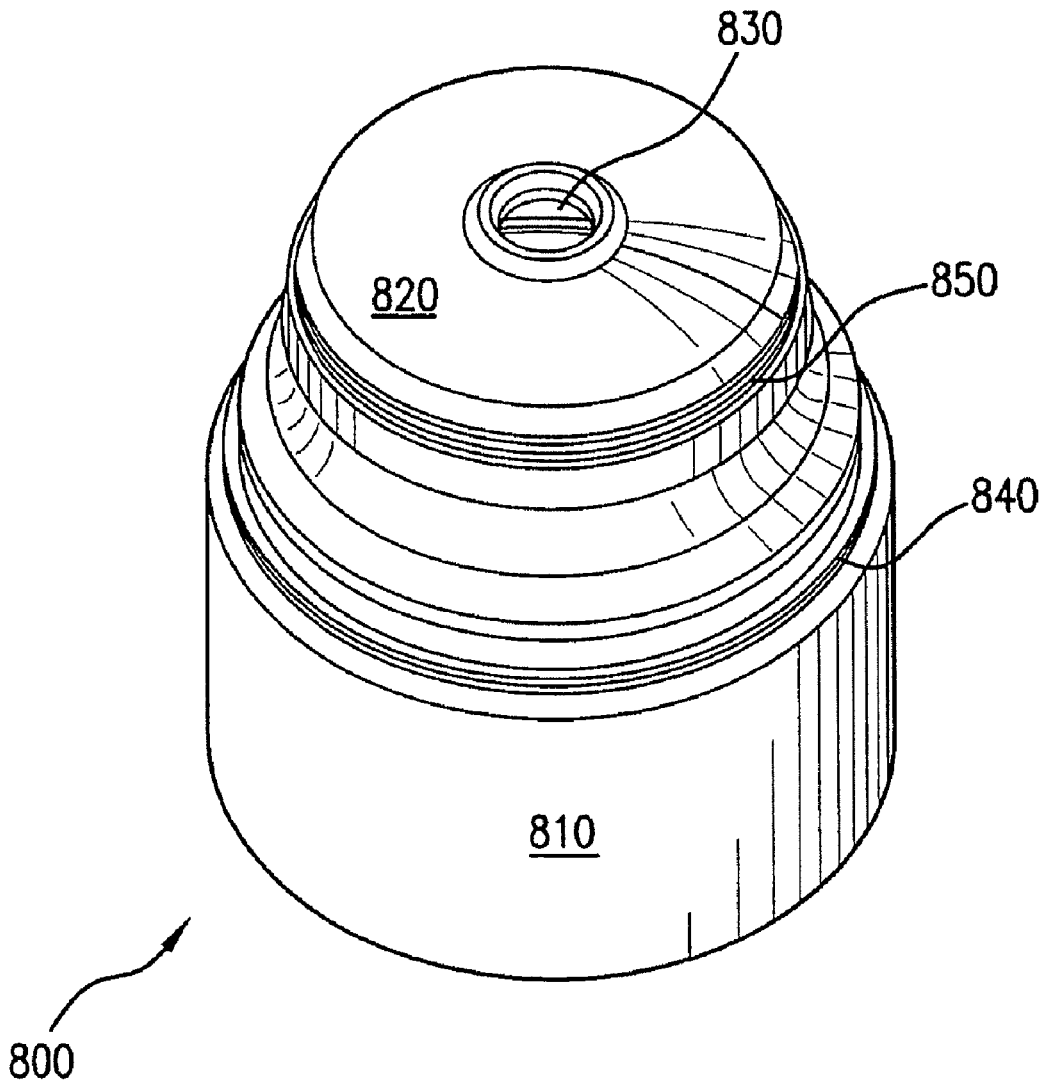
FIG. 8 is a perspective view from above of a container attachment according to an exemplary embodiment of the present invention.

FIG. 8 is a perspective view from above of container attachment 800 according to an exemplary embodiment of the present invention. Container attachment 800 includes side skirt 810 and container end plane 820. Container end plane 820 includes fitment receiver opening 830 arranged in the center, though in alternative embodiments fitment receiver opening 830 may be arranged in another part of container end plane 820. Fitment receiver opening 830 may be adapted to create a friction fit with a projection of a closure (for instance, projection 112 of closure cap 110 shown in FIG. 1). The friction fit may be between an internal diameter of fitment receiver opening 830 and an external diameter of a projection and/or an external diameter of fitment receiver opening 830 and an internal diameter of an annular projection. On the edge of container end plane 820 is opening fitting 850, which is arranged to cooperate with an opening of a closure (for instance, opening 122 of closure 100 shown in FIG. 1). Between opening fitting 850 and side skirt 810 is arranged closure fitting 840, which is arranged to cooperate with a skirt of a closure (for instance, retaining ring 125 on skirt 123 of closure 100 shown in FIG. 2).

Figure 9:
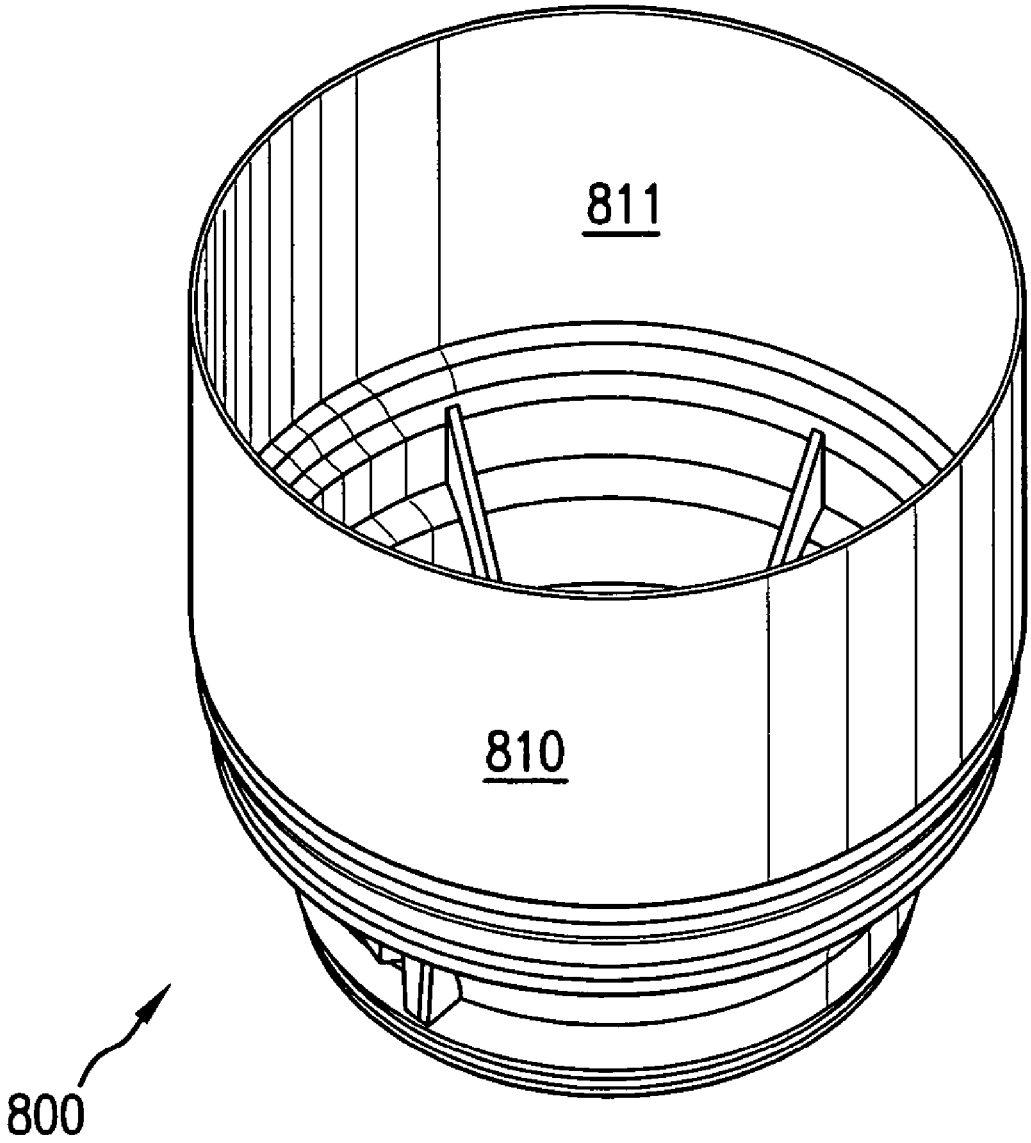
FIG. 9 is a perspective view from below of the container attachment of FIG. 8.

FIG. 9 is a perspective view from below of container attachment 800 of FIG. 8. Container attachment 800 includes side skirt 810 and, on an inside surface of side skirt 810, skirt attachment surface 811. Skirt attachment surface 811 is adapted to attach to a container, e.g., a tube, etc., that may include a liquid and/or a paste product, etc. Skirt attachment surface 811 may attach to a container or tube by a conventional method, e.g., a welding, an ultrasonic welding, a pressure treatment, or other appropriate method, etc.

Figure 10:
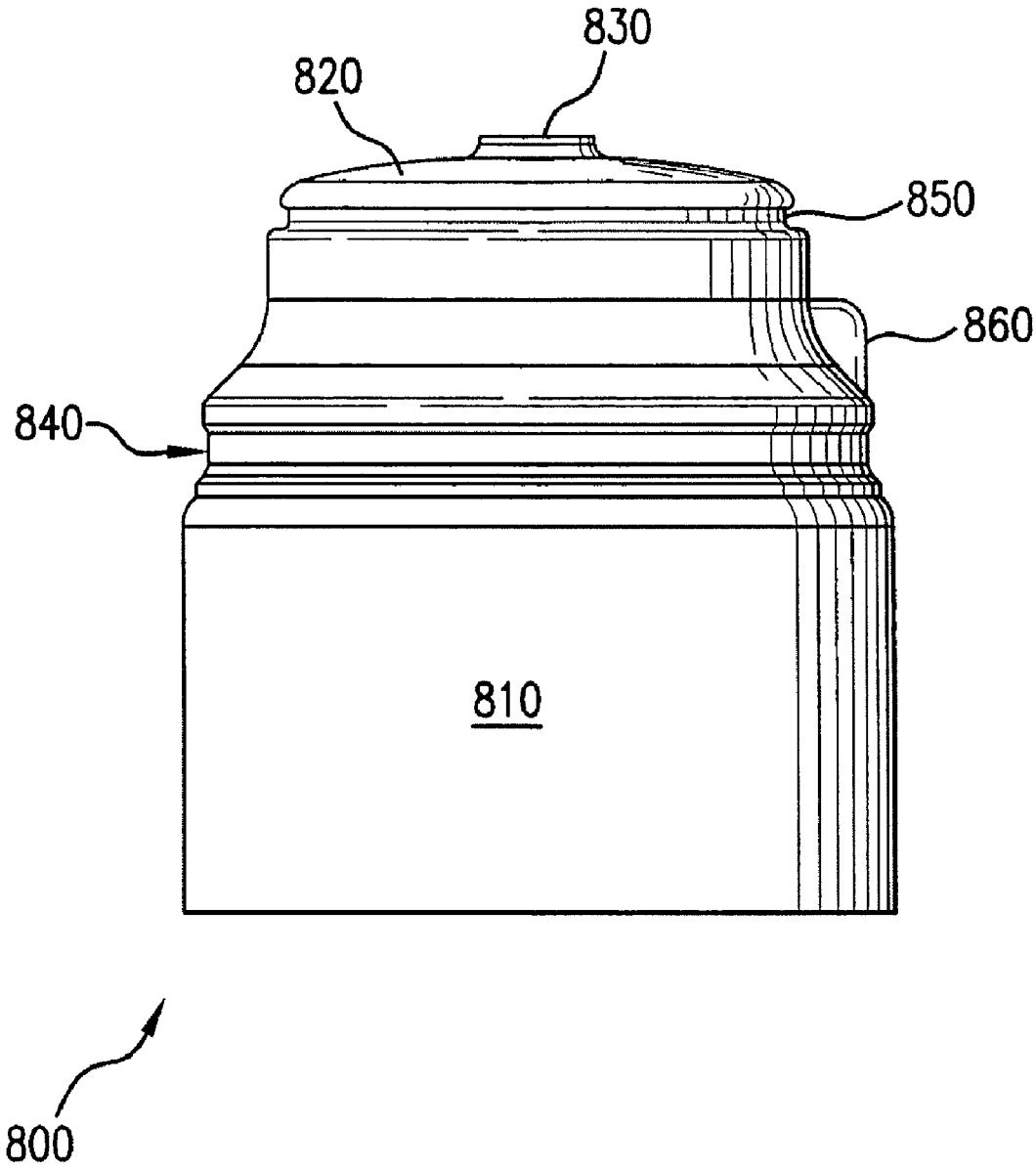
FIG. 10 is a side view of the container attachment of FIG. 8.

FIG. 10 is a sideview of container attachment 800 of FIG. 8. Container attachment 800 includes side skirt 810 and container end plane 820. Container end plane 820 includes fitment receiver opening 830. Between container end plane 820 and side skirt 810 is opening fitting 850 and closure fitting 840. Between opening fitting 850 and closure fitting 840 is arranged alignment fitting 860, which is arranged to receive an alignment guide of a closure (for instance, alignment guide 126 of closure 100 shown in FIG. 2).

Figure 11:
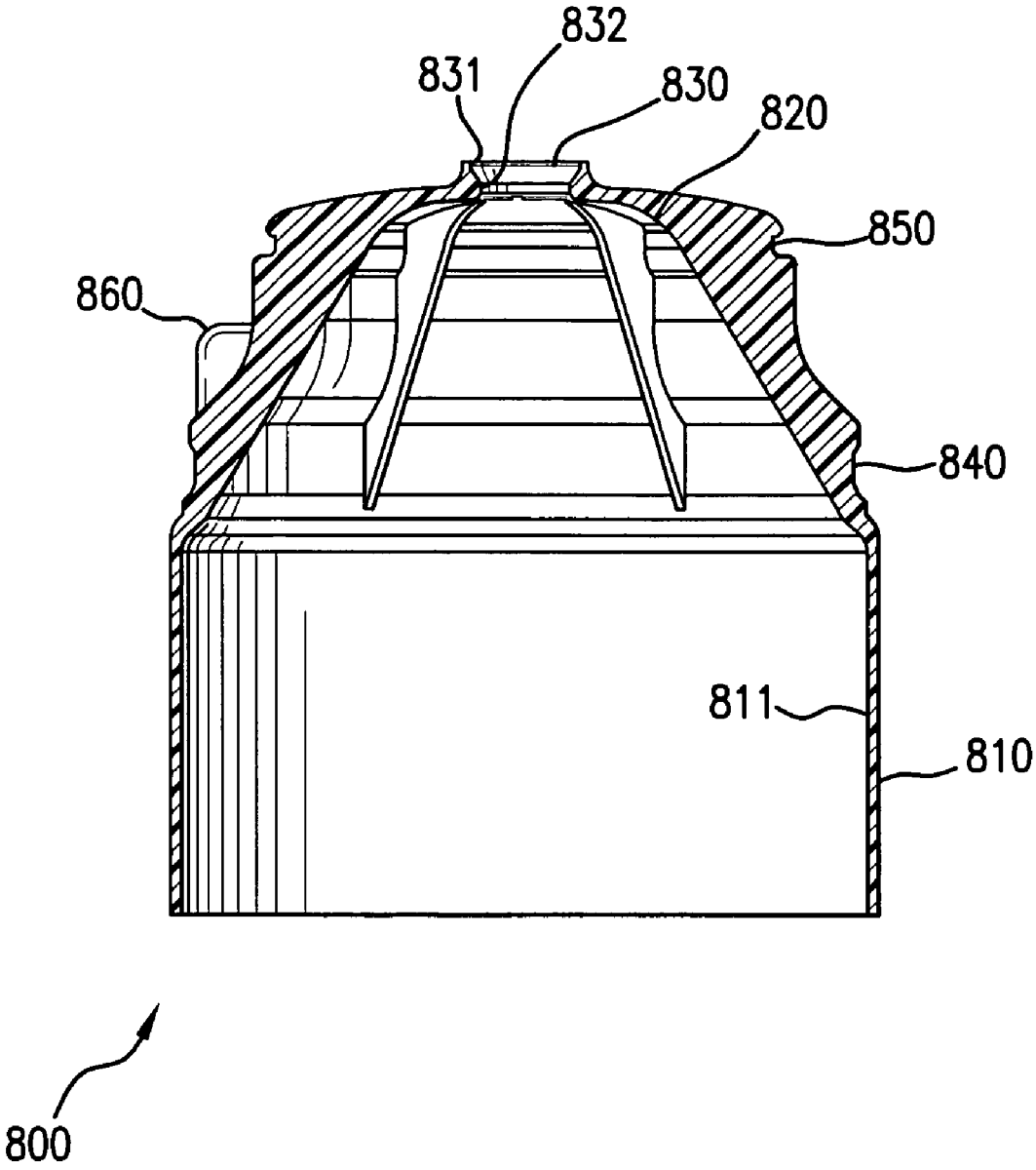
FIG. 11 is a cross-sectional view of the container attachment of FIG. 8.

FIG. 11 is a cross-sectional view of container attachment 800 of FIG. 8. Container attachment 800 includes side skirt 810 on an outside surface and skirt attachment surface 811 on an outside surface. Container end plane 820 includes fitment receiver opening 830. Fitment receiver opening 830 includes fitment guide section 831 arranged near the top of fitment receiver opening 830 and friction fitment section 832 arranged near a bottom of fitment receiver opening 830. Fitment guide section 831 is adapted to receive and guide a fitment and/or a projection from a closure that is being closed (for instance, projection 112 of closure 100 in FIG. 1). Friction fitment section 832 is adapted to receive and engage in a friction fit a fitment and/or a projection from a closure that is being closed (for instance, projection 112 of closure 100 in FIG. 1). Between container end plane 820 and side skirt 810 is opening fitting 850 and closure fitting 840. Between opening fitting 850 and closure fitting 840 is arranged alignment fitting 860, which is arranged to receive an alignment guide of a closure (for instance, alignment guide 126 of closure 100 shown in FIG. 2.

Figure 12:
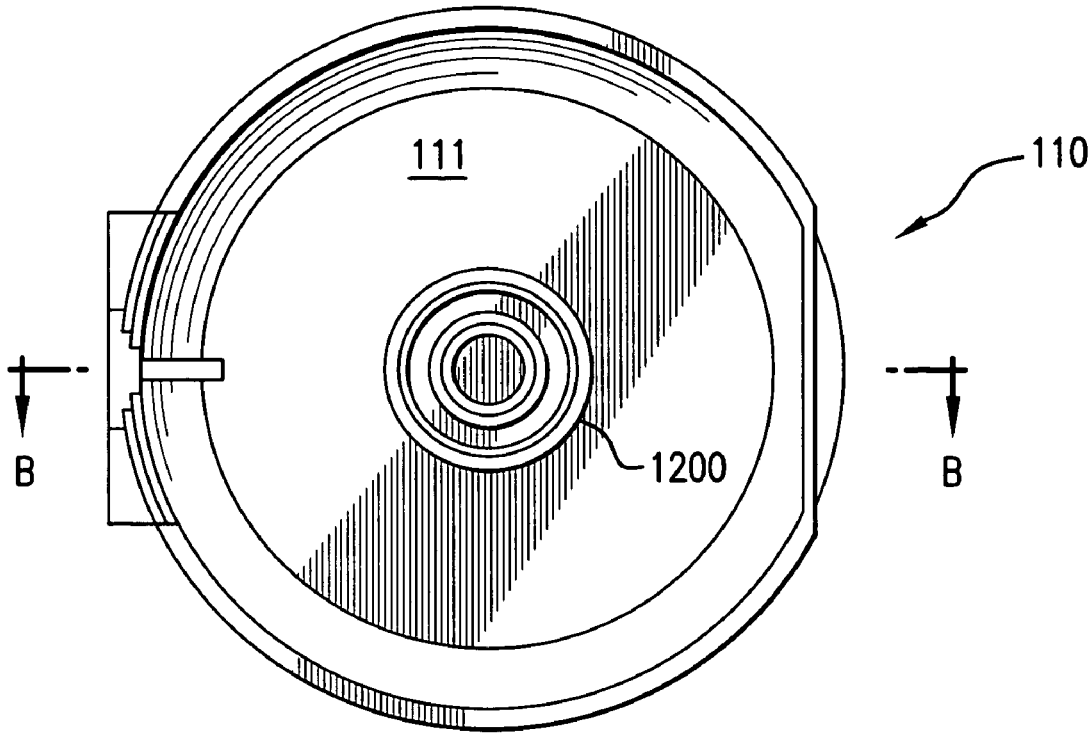
FIG. 12 is a view from below of a closure cap according to an exemplary embodiment of the present invention.

FIG. 12 is a view from below of closure cap 110 according to an exemplary embodiment of the present invention. Closure cap 110 includes closure plane 111 and double projection 1200 arranged centrally on closure plane 111. Double projection 1200 may be adapted to improve a seal of an opening of a tube and may be suited to sealing tubes with larger diameters, for instance openings having a diameter greater than 0.25 inches.

Figure 13:
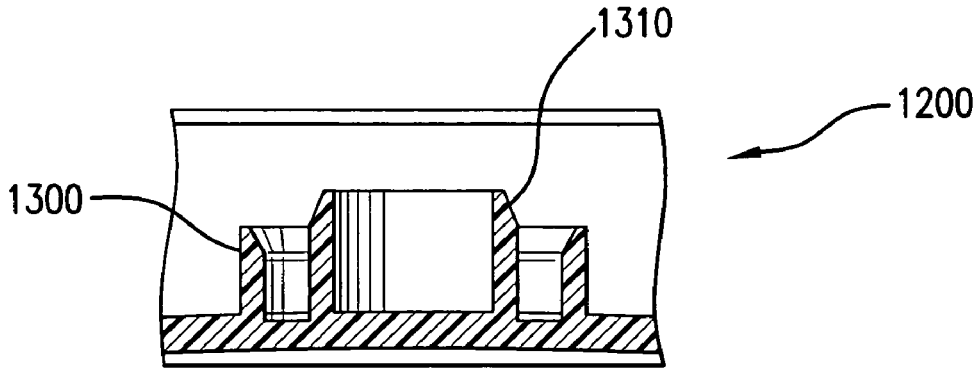
FIG. 13 is a side, cross-sectional view of the projection of FIG. 12, taken along line B-B of FIG. 12.

FIG. 13 is a side, cross-sectional view of double projection 1200 of FIG. 12, taken along line B-B of FIG. 12. Double projection 1200 includes outer annular projection 1300 and inner annular projection 1310 arranged radially inward of outer annular projection 1310.

Figure 14:
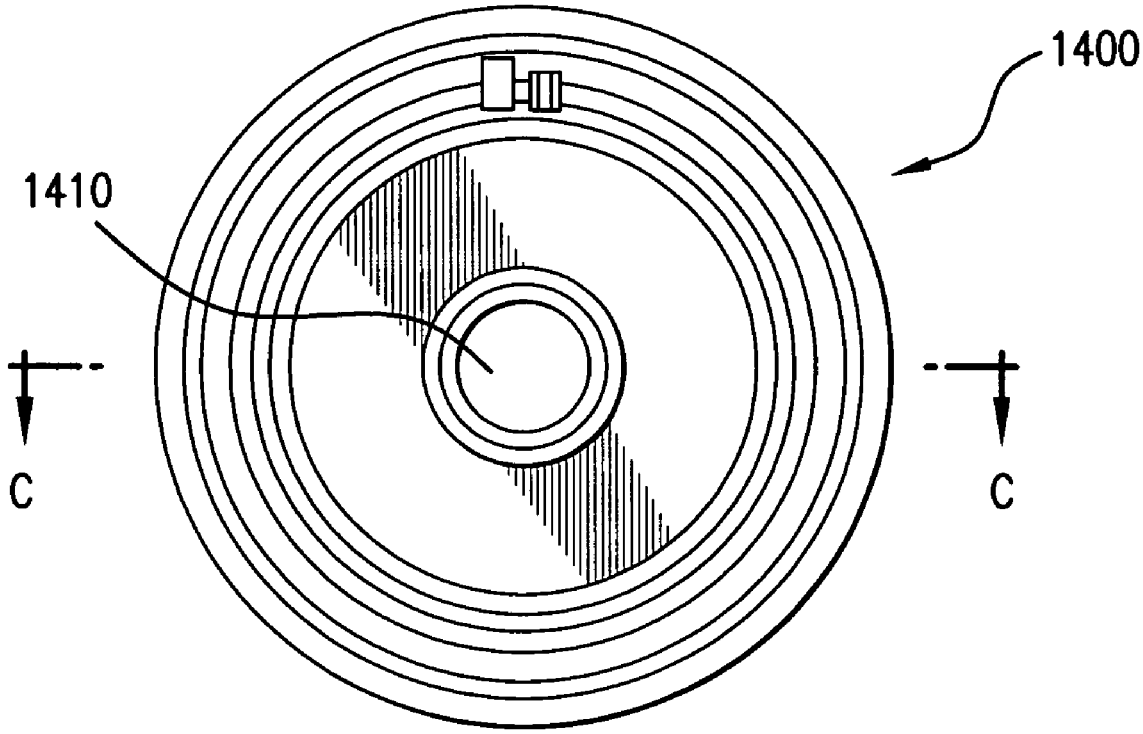
FIG. 14 is a plan view from above of a container attachment according to an exemplary embodiment of the present invention.

FIG. 14 is a plan view from above of alternative container attachment 1400 according to an exemplary embodiment of the present invention. Alternative container attachment 1400 includes double projection receiver opening 1410.

In an alternative exemplary embodiment, an external diameter of a projection of a closure (for instance, projection 112 of closure cap 110 shown in FIG. 1) may create a friction fit with an internal diameter of a fitment receiver opening on a container attachment (for instance, a container attachment 800 of FIG. 8). In another exemplary embodiment, an internal diameter of a projection of a closure (for instance, projection 112 of closure cap 110 shown in FIG. 1) may create a friction fit with an external diameter of a fitment receiver opening.

Figure 15:
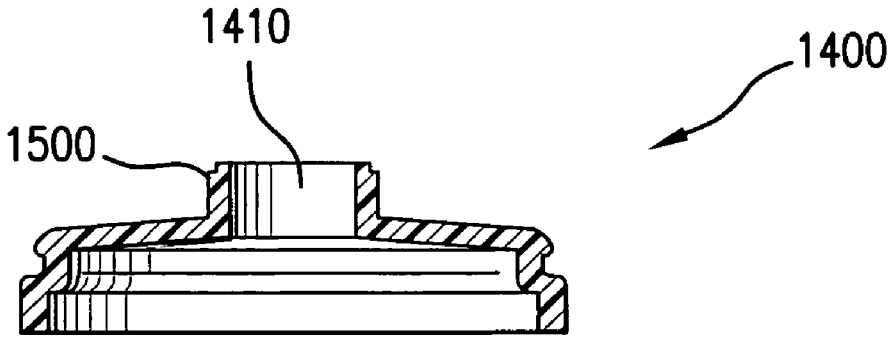
FIG. 15 is a side, cross-sectional view of the container attachment of FIG. 14, taken along line C-C of FIG. 14.

FIG. 15 is a side, cross-sectional view of alternative container attachment 1400 of FIG. 14, taken along line C-C of FIG. 14. Double projection receiver opening 1410 is defined by opening sidewall 1500. When using a closure cap that includes a double projection, as shown in FIGS. 12 and 13, with alternative container attachment 1400, inner annular projection 1310 may make a friction fit with a radially inward wall of opening sidewall 1500, and/or outer annular projection 1300 may make a friction fit with a radially outward wall of opening sidewall 1500. The outer annular projection 1300 may include an internal locking element, e.g., a lip, groove, etc., and/or inner annular projection 1310 may include an external locking element, e.g., a lip, groove, etc., engageable with corresponding locking elements on an interior portion and/or an exterior portion of the opening 1410.

Figure 16:
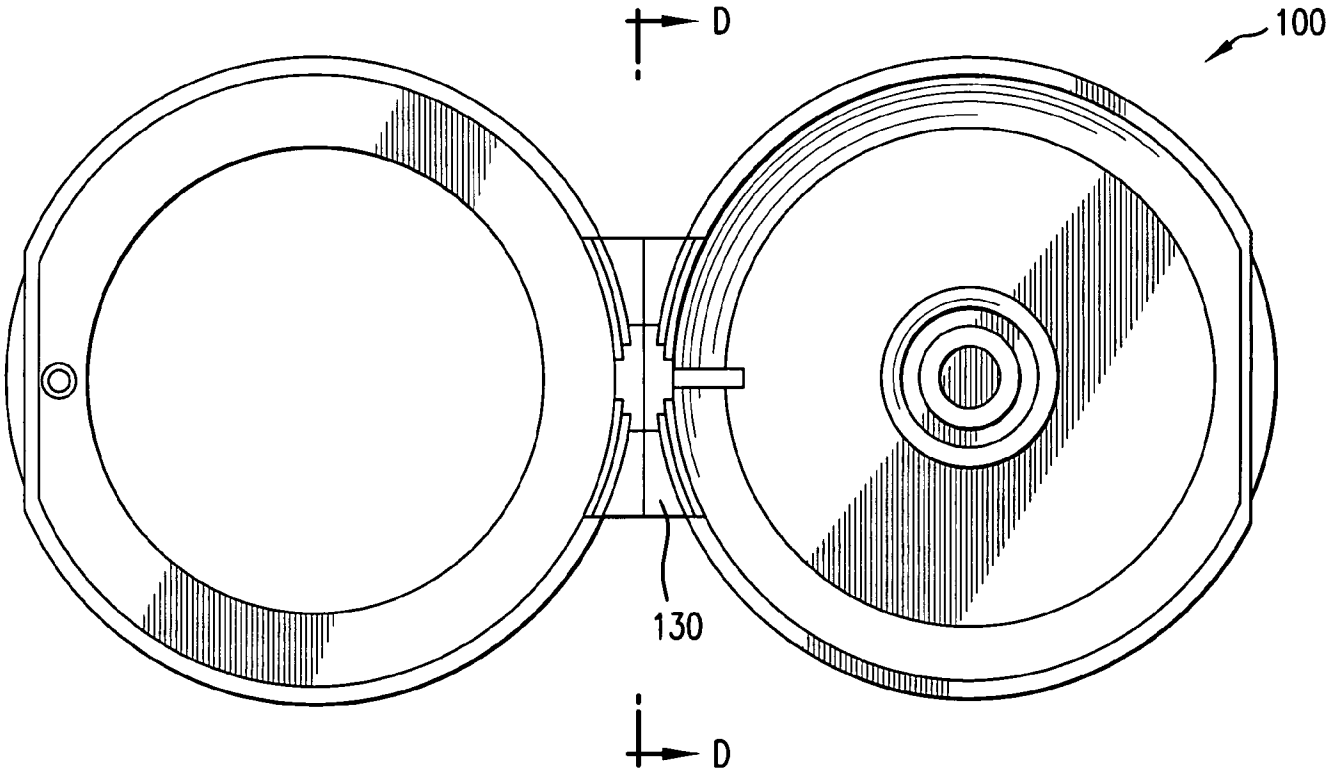
FIG. 16 is a plan view from above of a closure in an open position according to an exemplary embodiment of the present invention.

FIG. 16 is a plan view from above of closure 100 in an open position according to an exemplary embodiment of the present invention. Closure 100 includes hinge 130.

Figure 17:
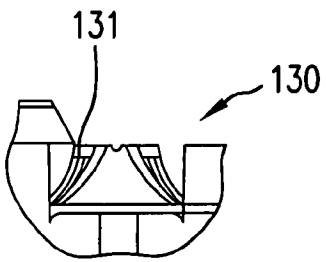
FIG. 17 is a side, cross-sectional view of the hinge of the closure of FIG. 16, taken along line D-D of FIG. 16.

FIG. 17 is a side, cross-sectional view of hinge 130 of the closure of FIG. 16, taken along line D-D of FIG. 16. Hinge 130 includes hinge tab 131. Hinge tab 131 may be of an equal thickness along the length of hinge tab 131 extending from the closure cap to the circumferentially depending outer skirt.

Figure 18:
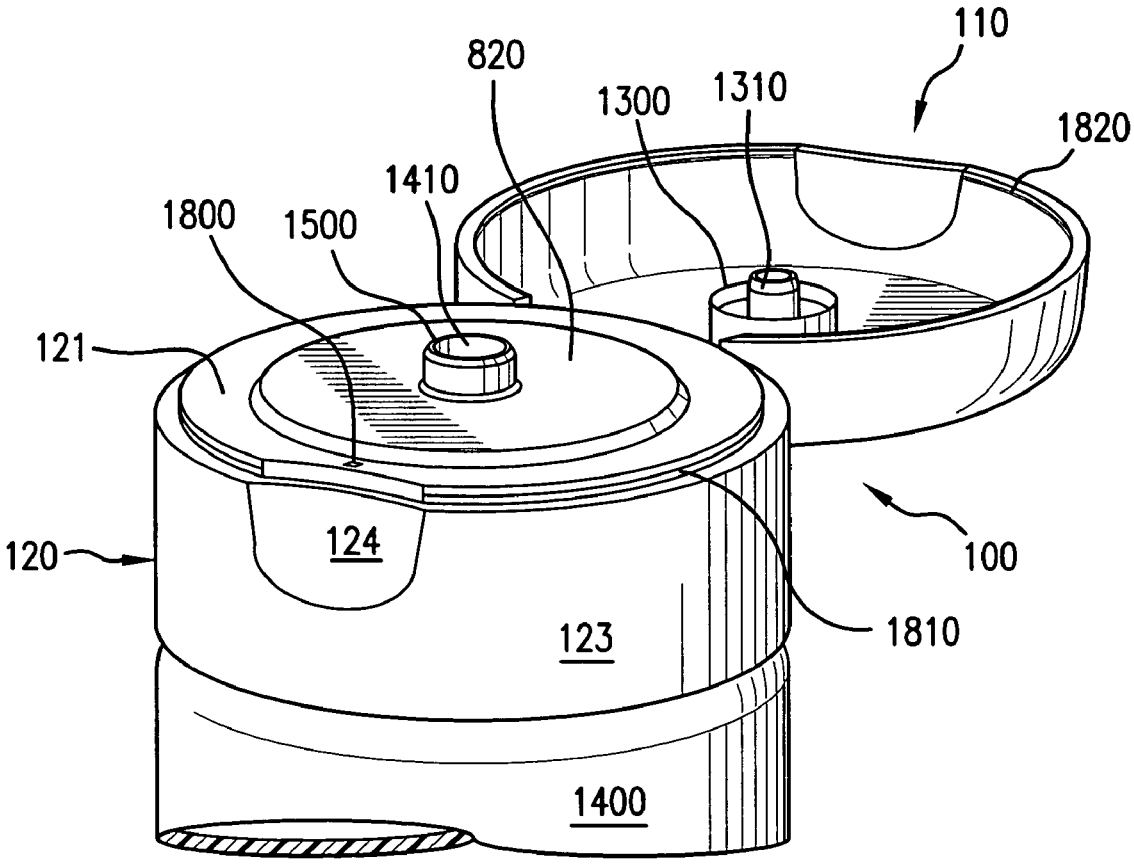
FIG. 18 is a perspective view from above of a closure and container attachment in combination in an open position according to an exemplary embodiment of the present invention.

FIG. 18 is a perspective view from above of closure 100 and alternative container attachment 1400 in combination in an open position according to an exemplary embodiment of the present invention. Closure 100 includes closure cap 110 connected by a hinge to circumferentially depending outer skirt 120. Closure cap 110 includes outer annular projection 1300 and inner annular projection 1310. Circumferentially depending outer skirt 120 includes closure plane lip 121, skirt 123, and opening depression 124 in skirt 123 opposite to the hinge. Closure plane lip 121 includes gate 1800 arranged adjacent to opening depression 124. On the edge of closure plane lip 121 is closure ridge 1810, which is adapted to cooperate with cap ridge 1820 to hold closure cap 110 in a closed position on circumferentially depending outer skirt 120 when closure cap 110 is closed. Container end plane 820 of alternative container attachment 1400 fills the opening of circumferentially depending outer skirt 120. Opening sidewall 1500 defining double projection receiver opening 1410 is arranged centrally on container end plane 820.

Figure 19:
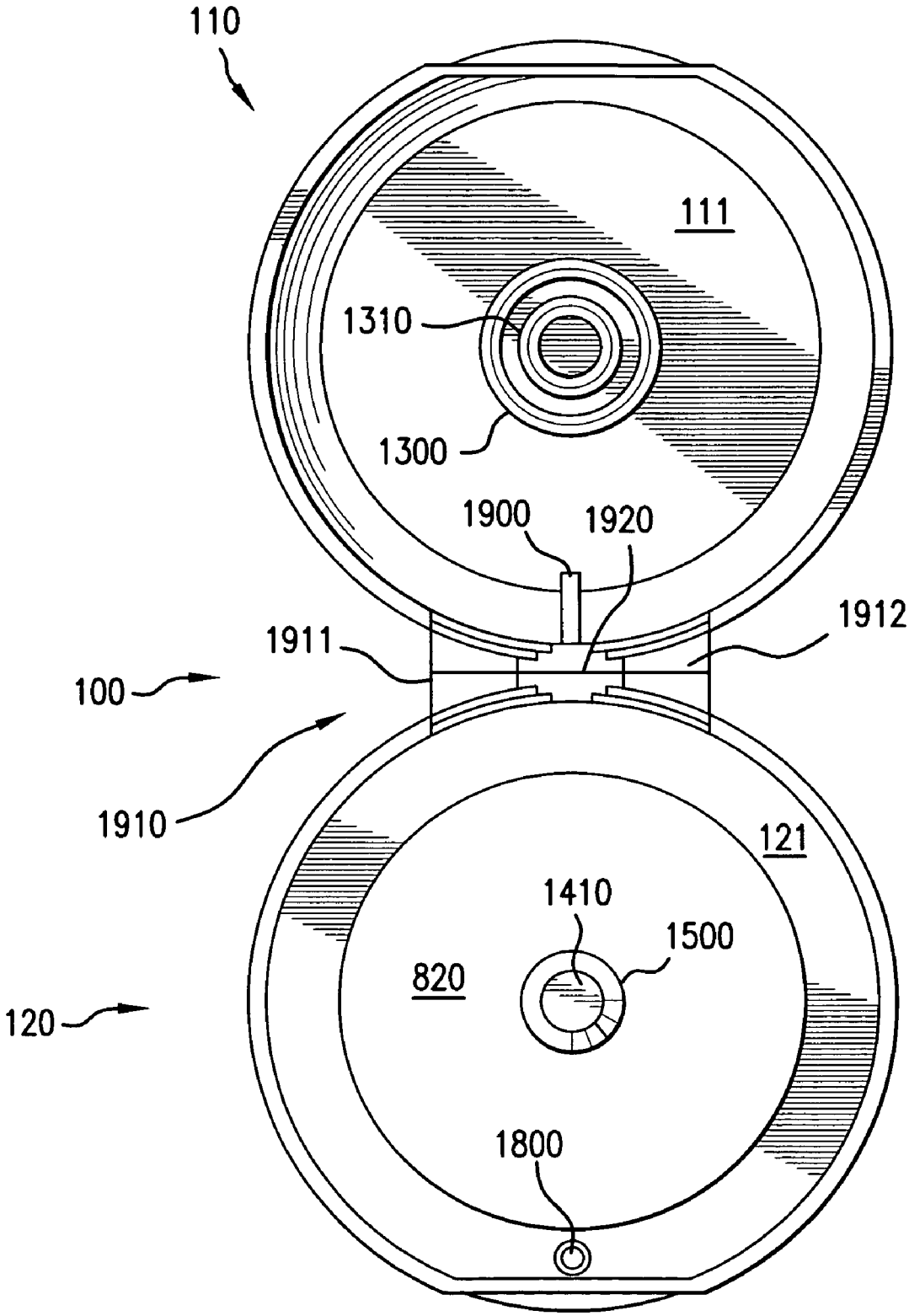
FIG. 19 is a plan view from above of a closure and container attachment in combination in an open position according to an exemplary embodiment of the present invention.

FIG. 19 is a plan view from above of closure 100 and an alternative container attachment in combination in an open position according to an exemplary embodiment of the present invention. Closure 100 includes closure cap 110 connected by one-piece hinge 1910 to circumferentially depending outer skirt 120. One-piece hinge 1910 includes hinge wings 1911, 1912 and central pivot hinge 1920. Closure cap

110 includes closure plane 111, outer annular projection 1300 and inner annular projection 1310. Circumferentially depending outer skirt 120 includes closure plane lip 121. Closure plane lip 121 includes gate 1800 arranged opposite to hinges 131, 132. Container end plane 820 of alternative container attachment 1400 fills the opening of circumferentially depending outer skirt 120. Opening sidewall 1500 defining double projection receiver opening 1410 is arranged centrally on container end plane 820. Closure cap 110 includes stabilizing ridge 1900 arranged adjacent to hinges 131, 132. Stabilizing ridge 1900 may stabilize closure cap 110 during opening and closing, and may ensure that closure cap 110 is aligned with circumferentially depending outer skirt 120 when closure cap 110 is being closed.

What is claimed is:

1. A system comprising a container including a container end plane including a fitment receiver opening and an alignment fitting providing an axial groove at a single desired radial location, and a closure including a closure cap, a circumferentially depending outer first skirt having a top and a bottom, and a hinge connecting the closure cap and the circumferentially depending outer first skirt, the closure cap including a closure plane and an outer closure second skirt, the circumferentially depending outer first skirt including a closure plane lip at the top, an opening at the top, and an alignment guide extending from the closure plane lip at the top toward the bottom and arranged to extend inwardly from the outer first skirt on a specific radial position to cooperate with the axial groove provided by the alignment fitting formed on the container to ensure that the closure maintains a specific radial orientation with respect to the container, and wherein the closure is coupled to the container.

2. The system of claim 1, wherein the closure further includes a section extending inwardly from the outer first skirt and cooperating with a circumferential groove on a neck region of the container to attach the closure to the container.

3. The system of claim 2, wherein the section is a fitment retaining ring included in the circumferentially extending outer first skirt and coupled to the outer first skirt.

4. The system of claim 2, wherein the section is the closure plane lip included in the circumferentially extending outer first skirt and coupled to the outer first skirt.

5. The system of claim 1, wherein the outer closure second skirt includes an opening tab on a side of the closure cap opposite to the hinge and the circumferentially depending outer first skirt includes an opening depression in the outer first skirt opposite to the alignment guide and to the hinge.

6. The system of claim 5, wherein the closure further includes a projection arranged radially inward of opening tab on the outer closure second skirt to engage with an indentation on the circumferentially depending outer first skirt to hold the closure cap in a closed position on the circumferentially depending outer first skirt.

7. The system of claim 1, wherein the outer first skirt and the closure plane lip cooperate to form an interior region containing the alignment guide and the container end plane and the alignment guide is coupled to interior portions of each of the outer first skirt and the closure plane lip.

8. The system of claim 1, wherein the closure cap includes a stabilizing ridge arranged adjacent to the hinge and adapted to maintain the closure cap and the outer first skirt in alignment during at least one of a closing operation and an opening operation and wherein the alignment guide and the stabilizing ridge are arranged to lie in spaced-apart relation to one another to locate a portion of the hinge therebetween when the closure cap is moved away from the container during the opening operation.

9. The system of claim 8, wherein the outer closure second skirt and the closure plane cooperate to form an interior region containing the stabilizing ridge and the stabilizing ridge is coupled to each of the outer closure second skirt and the closure plane.

10. A system comprising a container including a top wall formed to include a product-discharge outlet, a side wall extending downwardly from the top wall, and an alignment fitting at a single desired radial location coupled to an exterior portion of the side wall, and a closure including a body having an opening at a top of the body, a flip-top cap, and a hinge coupled to the body and to the flip-top cap to support the flip-top cap for movement from a closed position on the body covering the product-discharge outlet to an opened position away from the body uncovering the product-discharge outlet, wherein the body is formed to include a fitment retaining ring extending inwardly from the body and cooperating with a circumferential groove on the container to couple the body to the container and an alignment guide coupled to an interior wall of the body, the alignment guide extending from the opening at the top toward the fitment retaining ring, the closure is formed so that the top opening exposes the product-discharge outlet formed in the top wall of the container, and the alignment guide on the interior wall of the body of the closure is arranged to mate with the alignment fitting on the container to ensure that the closure does not rotate with respect to the container upon mating engagement of the closure and the container to orient the closure in a fixed position on the container.

11. The system of claim 10, wherein the body includes a lip defining a boundary of the top opening, and the side wall of the container is formed to include an opening fitting arranged to cooperate with the top opening of the container mount and to confront the lip.

12. The system of claim 11, wherein the lip is arranged to extend into the opening fitting to attach the closure to the container.

13. The system of claim 11, wherein the lip is coupled to the alignment guide.

14. The system of claim 13, wherein the body further includes a skirt coupled to and arranged to extend downwardly from the lip and the alignment guide is also coupled to the skirt.

15. The system of claim 10, wherein the side wall of the container is formed to include a closure fitting which is arranged to cooperate with a retaining ring of a skirt included in the body of the closure to retain the closure on the container.

16. The system of claim 15, wherein the alignment fitting is located between the top wall of the container and the closure fitting.

17. The system of claim 16, wherein the side wall of the container is also formed to include an opening fitting located between the top wall of the container and the alignment fitting and arranged to receive a portion of the body therein and the alignment fitting is located between the opening fitting and the closure fitting.

18. The system of claim 10, wherein the flip-top cap includes a ceiling, an outer closure skirt coupled to a circular perimeter edge of the ceiling, and a stabilizing ridge coupled to an interior surface of the outer closure skirt and wherein the alignment guide and the stabilizing ridge are arranged to lie in spaced-apart relation to one another to locate a portion of the hinge therebetween when the flip-top cap is moved to the opened position.

19. A system comprising a container including a top wall formed to include a product-discharge outlet and a side wall extending downwardly from the top wall and forming an axial groove at a single desired radial location arranged to lie in spaced-apart parallel relation to a central axis extending through the product-discharge outlet and along a length of a container, and a closure including a body coupled to the side wall of the container and formed to include a top opening exposing the product-discharge outlet, a flip-top cap, and a hinge coupled to the body and to the flip-top cap to support the flip-top cap for movement from a closed position on the body covering the product-discharge outlet to an opened position away from the body uncovering the product-discharge outlet, wherein the body is formed to include a closure plane lip at the top opening and a fitment retaining ring extending inwardly from the body and spaced from the top opening, the fitment retaining ring being shaped for attachment to the container, the body including an alignment guide above the fitment retaining ring and extending from the closure plane lip toward the fitment retaining ring, the alignment guide being arranged to extend into the axial groove formed in the side wall of the container to define means for ensuring that the closure maintains a specific radial orientation with respect to the container, and wherein the closure is coupled to the container.

* * * * *